US007584238B2

(12) United States Patent
Huber

(10) Patent No.: US 7,584,238 B2
(45) Date of Patent: Sep. 1, 2009

(54) ANALOG CIRCUIT SYSTEM FOR GENERATING ELLIPTIC FUNCTIONS

(75) Inventor: Klaus Huber, Darmstadt (DE)

(73) Assignee: Deutsche Telekom AG, Bonn (DE)

( * ) Notice: Subject to any disclaimer, the term of this patent is extended or adjusted under 35 U.S.C. 154(b) by 488 days.

(21) Appl. No.: 10/555,513

(22) PCT Filed: Feb. 9, 2004

(86) PCT No.: PCT/DE2004/000223

§ 371 (c)(1),
(2), (4) Date: Feb. 6, 2006

(87) PCT Pub. No.: WO2004/097713

PCT Pub. Date: Nov. 11, 2004

(65) Prior Publication Data

US 2007/0244945 A1 Oct. 18, 2007

(30) Foreign Application Priority Data

May 2, 2003 (DE) ..... 103 19 637

(51) Int. Cl.
*G06G 7/00* (2006.01)

(52) U.S. Cl. ..... 708/801

(58) Field of Classification Search ..... 708/801
See application file for complete search history.

(56) References Cited

U.S. PATENT DOCUMENTS 3,821,949 A * 7/1974 Hartzell et al. ..... 600/545
3,900,823 A * 8/1975 Sokal et al. ..... 330/149
5,121,009 A * 6/1992 Braathen ..... 327/552
2004/0172432 A1 9/2004 Huber et al.

FOREIGN PATENT DOCUMENTS

DE 22 14 689 A 9/1973
DE 10249050 A1 5/2004
EP 0 331 246 A 9/1989

OTHER PUBLICATIONS

Wolfram Research Inc., "JacobiSN" [Online], Dec. 31, 2001, http://functions.wolfram.com/PDF/JacobiSN.pdf, http://functions.wolfram.com/09.36.03.0003.01 , p. 1, last paragraph.

Wolfram Research Inc., "JacobiSD" [Online], Dec. 31, 2001, XP002305143, http://functions.wolfram.com/PDF/JacobiSD.pdf, http://functions.wolfram.com/09.34.02.0001.01, p. 1, paragraph 2.

Wolfram Research Inc., "JacobiCD" [Online], Dec. 31, 2001, http://functions.wolfram.com/PDF/JacobiCD.pdf, http://functions.wolfram.com/09.25.02.0001.01, p. 1, paragraph 2.

* cited by examiner

*Primary Examiner*—Tan V Mai
(74) *Attorney, Agent, or Firm*—Kenyon & Kenyon LLP

(57) ABSTRACT

An analog circuit system for generating output signals whose curve shape, at least sectionally, corresponds or is approximate to an elliptic function. Standard analog components such as adders, integrators, multipliers and differential amplifiers can be interconnected in order to simulate elliptic time functions from the standpoint of circuit engineering.

7 Claims, 3 Drawing Sheets

ANALOG CIRCUIT SYSTEM FOR GENERATING ELLIPTIC FUNCTIONS

FIELD OF THE INVENTION

The present invention relates to an analog circuit system having a plurality of analog computing circuits for generating elliptic functions.

BACKGROUND TECHNOLOGY

Elliptic functions and integrals are used in numerous applications in engineering practice. The elliptic functions occurring frequently are the so-called Jacobi elliptic functions sn(x, k), cn(x,k), dn(x,k). The characteristic of the function sn(x,k) is similar to the sine function, while the function cn(x,k) is similar to the cosine function. For k=0, the functions sn(x,0) and cn(x,0) change into the sine function and cosine function, respectively. The value of k lies mostly in the interval [0, 0,].

Elliptic functions play a role in information and communication technology, e.g., in the design of Cauer filters, because some parameters of the Cauer filter are linked by elliptic functions. German patent reference 102 49 050.3 apparently describes a method and an arrangement for adjusting an analog filter with the aid of elliptic functions. Elliptic functions are likewise used in the two-dimensional representation, interpolation or compression of data, for example, see German patent reference 102 48 543.7.

SUMMARY OF INVENTION

The present invention provides for analog circuit systems that are able to electrically simulate elliptic functions.

For example, an analog circuit system has a plurality of analog computing circuits such as analog multipliers, adders, integrators, differential amplifiers and dividers, which generate at least one output signal whose curve shape, at least sectionally, corresponds or is approximate to an elliptic function.

In embodiments of the present invention, Jacobi elliptic functions are electrically simulated by the analog circuit system.

In embodiments of the present invention, an analog circuit system includes analog multipliers and integrators which are able to deliver three output signals whose curve shapes, at least sectionally, correspond or are approximate to the Jacobi elliptic time functions $$sn\left(\frac{2\hat{\pi}}{T}\cdot t, k\right),\quad cn\left(\frac{2\hat{\pi}}{T}\cdot t, k\right)\ \text{and}\ dn\left(\frac{2\hat{\pi}}{T}\cdot t, k\right).$$

In these time functions, k is the module of the elliptic functions, f=1/T is the frequency of the elliptic time functions, and $$\hat{\pi} = \frac{\pi}{M\left(1, \sqrt{1-k^2}\right)},$$

where $M(1,\sqrt{1-k^2})$ represents the so-called arithmetic-geometric mean of 1 and $\sqrt{1-k^2}$. The value k lies mostly in the interval [0, 1].

An application case can frequently occur in which a specific output signal is assigned to an input signal. Therefore, in embodiments of the present invention, a plurality of analog computing circuits are interconnected in such a way that, given an input variable x, output variable y is an elliptic function of x.

If a triangle function is applied as input signal to a circuit system, which, for example, realizes sn(x), an elliptic time function is obtained at the output.

A circuit system able to generate this functional relationship has a first multiplier, at whose one input an input signal having the quantity x, for example, a triangular input signal, is applied, and at whose other input the factor $(1-k^2)/2$ is applied. A second multiplier can be provided, at whose one input the triangular input signal is applied, and at whose other input the factor $(1+k^2)/2$ is applied. A differential amplifier is connected to the output of the second multiplier, a further input of the differential amplifier being connected to ground. An adder is also provided which is connected to the output of the first multiplier and the output of the differential amplifier. Present at the output of the adder is an output signal $U_a$ which is combined or linked with the input signal by the Jacobi elliptic function $sn(U_e)$.

Further elliptic functions may be realized with the aid of an analog division device. To generate an output signal according to the elliptic function $$sd\left(\frac{2\hat{\pi}}{T}\cdot t, k\right),$$

output signals $$sn\left(\frac{2\hat{\pi}}{T}\cdot t, k\right)\ \text{and}\ dn\left(\frac{2\hat{\pi}}{T}\cdot t, k\right)$$

are applied to the analog division device. To generate an output signal according to the elliptic function $$cd\left(\frac{2\hat{\pi}}{T}\cdot t, k\right),$$

output signals $$cn\left(\frac{2\hat{\pi}}{T}\cdot t, k\right)\ \text{and}\ dn\left(\frac{2\hat{\pi}}{T}\cdot t, k\right)$$

are applied to the inputs of the analog division device.

In many cases, one wants to selectively control or influence the frequency $$f = \frac{1}{T},$$

as well as the value k of an elliptic function. An exemplary application case is, for example, the voltage-controlled change of frequency f, oscillation period T or module k. For this purpose, one should specifically select the value of, frequency f and the value of $\hat{\pi}$. As mentioned above, the variables $\hat{\pi}$ and $\pi$ can have the following relationship:

$$\hat{\pi} = \frac{\pi}{M(1, \sqrt{1-k^2})}$$

For this reason, the arithmetic-geometric mean $M(1, \sqrt{1-k^2})$ can be simulated with the aid of analog computing circuits.

In embodiments of the present invention, at least one analog computing circuit is provided, at whose first input, the value 1 is applied, and at whose second input, the factor $\sqrt{1-k^2}$ is applied. The arithmetic mean of the two input signals is present at the first output of the analog computing circuit, whereas the geometric mean of the two input signals is present at the second output of the analog computing circuit. Moreover, an analog computing circuit, connected to the outputs of the analog computing devices or circuits, is provided for calculating the arithmetic mean, which corresponds approximately to the arithmetic-geometric mean $M(1,\sqrt{1-k^2})$ of 1 and $\sqrt{1-k^2}$.

An alternative analog circuit system for generating the arithmetic-geometric mean $M(1,\sqrt{1-k^2})$ has one analog computing circuit for calculating the minimum from two input signals, one analog computing circuit for calculating the maximum from two input signals, one analog computing circuit for calculating the arithmetic mean from two input signals, and one analog computing circuit for calculating the geometric mean from two input signals. The output of the analog computing circuit for calculating the minimum is connected to an input of the analog computing circuit for calculating the arithmetic mean and an input of the analog computing circuit for calculating the geometric mean. The output of the analog computing circuit for calculating the maximum is connected to another input of the analog computing circuit for calculating the arithmetic mean and another input of the analog computing circuit for calculating the geometric mean. One input of the analog computing circuit for calculating the minimum is connected to the output of the analog computing circuit for calculating the arithmetic mean, the value 1 being applied to the other input. One input of the analog computing circuit for calculating the maximum is connected to the output of the analog computing circuit for calculating the geometric mean, the value $\sqrt{1-k^2}$ being applied to the other input.

Consequently, the arithmetic-geometric mean M o f 1 and $\sqrt{1-k^2}$ is present at the output of the analog computing circuit for calculating the geometric mean and at the output of the analog computing circuit for calculating the arithmetic mean.

To be able to provide the value $\hat{\pi}$ in terms of circuit engineering, a device, for example, a divider, is provided, at whose inputs, the arithmetic-geometric mean $M(1,\sqrt{1-k^2})$ and the number $\pi$ are applied.

DETAILED DESCRIPTION

Herein, analog circuit systems are discussed which generate at least one output signal whose curve shape corresponds or is approximate to a Jacobi elliptic time function. The so-called Jacobi elliptic functions sn(x,k), cn(x,k) and dn(x,k) are used in the following embodiment. In considering time functions, the variable x is replaced by t in the above functions, and, to simplify matters, the value of k is omitted in the following formulas.

Under these conditions, the following well-known equations may be indicated with respect to the Jacobi elliptic functions:

$$\frac{d}{dt} sn(t) = cn(t) \cdot dn(t) \tag{1}$$

$$\frac{d}{dt} cn(t) = -sn(t) \cdot dn(t) \tag{2}$$

$$\frac{d}{dt} dn(t) = -k^2 sn(t) \cdot cn(t). \tag{3}$$

Further, descriptions regarding elliptic functions may be found, inter alia, in the reference "*Vorlesungen über allgemeine Funktionentheorie und elliptischen Funktionen*," A. Hurwitz, Springer Verlag, 2000, page 204.

To permit electrical simulation of elliptic functions in which frequency f can be changed, it is necessary, similarly as in the case of the circular functions, to take into account corresponding multiplicative constants which appear in conjunction with variable t. Instead of circular constant $\pi$, constant $\hat{\pi}$ is used. Variable $\hat{\pi}$ has the following relation with variable $\pi$:

$$\hat{\pi} = \frac{\pi}{M(1, \sqrt{1-k^2})} \tag{4}$$

The function $M(1, \sqrt{1-k^2})$ forms the so-called arithmetic-geometric mean of 1 and $(\sqrt{1-k^2})$.

With period duration T and the insertion of $\hat{\pi}$, the following differential equations result:

$$\frac{d}{dt} sn\left(\frac{2\hat{\pi}}{T} \cdot t\right) = \frac{2\hat{\pi}}{T} \cdot cn\left(\frac{2\hat{\pi}}{T} \cdot t\right) \cdot dn\left(\frac{2\hat{\pi}}{T} \cdot t\right) \tag{5}$$

-continued $$\frac{d}{dt}cn\left(\frac{2\hat{\pi}}{T}\cdot t\right) = -\frac{2\hat{\pi}}{T}\cdot sn\left(\frac{2\hat{\pi}}{T}\cdot t\right)\cdot dn\left(\frac{2\hat{\pi}}{T}\cdot t\right) \tag{6}$$

$$\frac{d}{dt}dn\left(\frac{2\hat{\pi}}{T}\cdot t\right) = -k^2\frac{2\hat{\pi}}{T}\cdot sn\left(\frac{2\hat{\pi}}{T}\cdot t\right)\cdot cn\left(\frac{2\hat{\pi}}{T}\cdot t\right) \tag{7}$$

where f=1/T is the frequency of the elliptic functions.

Figure 1:
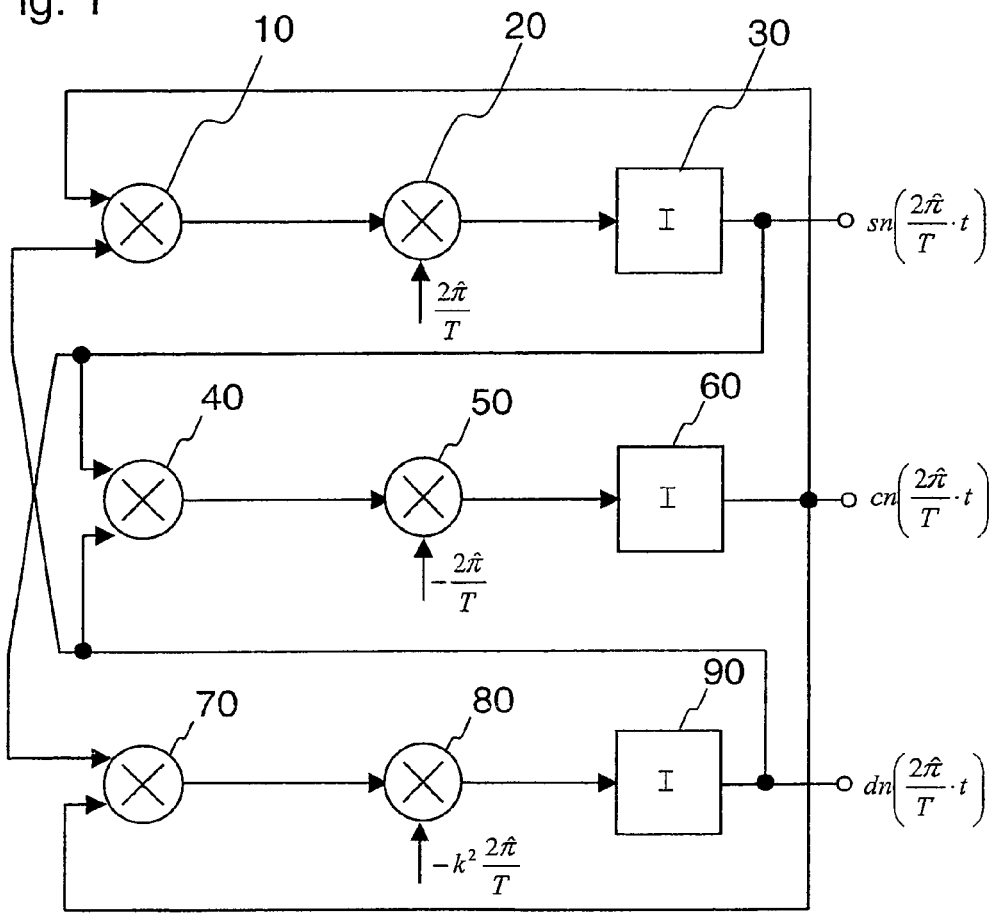
FIG. 1 shows an analog circuit system for generating three output signals, each corresponding to a Jacobi elliptic time function.

FIG. 1 shows an analog circuit system which generates three output signals whose curve shapes correspond to the Jacobi elliptic functions.

In FIG. 1, a multiplier 10, a multiplier 20, and an analog integrator 30, are connected in series. Moreover, an analog multiplier 40, an analog multiplier 50, and a further analog integrator 60, are connected in series. A third series connection includes a further analog multiplier 70, an analog multiplier 80, and an analog integrator 90. Analog multiplier 20 multiplies the output signal of multiplier 10 by the factor 2 $\hat{\pi}$/T. Multiplier 50 multiplies the output signal of multiplier 40 by the factor $$-\frac{2\hat{\pi}}{T}.$$

Multiplier 80 multiplies the output signal of multiplier 70 by the factor $$-k^2\frac{2\hat{\pi}}{T}.$$

The output signal of integrator 30 is coupled back to multiplier 40 and to the input of multiplier 70. The output signal of integrator 60 is coupled back to the input of multiplier 10 and to the input of multiplier 70. The output of integrator 90 is coupled back to the input of multiplier 40 and to the input of multiplier 10. Measures, available in circuit engineering, for taking into account predefined initial states during initial operation are not marked in the circuit. Such an analog circuit system, shown in FIG. 1, delivers the Jacobi elliptic time function sn(2$\hat{\pi}$ft) at the output of integrator 30, the Jacobi elliptic function cn(2$\hat{\pi}$ft) at the output of integrator 60, and the Jacobi elliptic function dn(2$\hat{\pi}$ft) at the output of integrator 90. The multiplication by $$\pm\frac{2\hat{\pi}}{T}$$

in multipliers 20, 50, respectively, and the multiplication by $$-k^2\frac{2\hat{\pi}}{T}$$

in multiplier 80 may also be carried out in integrators 30, 60, 90. The multiplication by $k^2$ may also be put at the output of integrator 90. Moreover, in further embodiments, it is possible to add familiar stabilization circuits to the circuit system shown in FIG. 1. See, for example, reference "*Halbleiter Schaltungstechnik*," Tietze, Schenk, Springer Verlag, 5$^{th}$ edition, 1980, Berlin, pages 435-438.

All three Jacobi elliptic time functions sn(2$\hat{\pi}$ft), cn(2$\hat{\pi}$ft) and dn(2$\hat{\pi}$ft) may be realized simultaneously using the analog circuit system shown in FIG. 1. In addition, the derivatives of the Jacobi elliptic time functions sn, cn and dn are obtained at the output of the multipliers 10, 40, 70, respectively.

If, for example, only the Jacobi elliptic time function sn((2 $\hat{\pi}$ft)) is to be realized using an analog circuit system, it is possible to get along with fewer multipliers by considering the differential equation of the second degree, valid for sn(2 $\hat{\pi}$ft), which may be derived from the differential equations indicated above. The differential equation of the second degree valid for sn(2$\hat{\pi}$ft) reads:

$$\frac{d^2}{dt^2}sn\left(\frac{2\hat{\pi}}{T}\cdot t\right) = -\left(\frac{2\hat{\pi}}{T}\right)^2\cdot sn\left(\frac{2\hat{\pi}}{T}\cdot t\right)\cdot\left(1+k^{2-}-2k^2sn^2\left(\frac{2\hat{\pi}}{T}\cdot t\right)\right) \tag{8}$$

Figure 2:
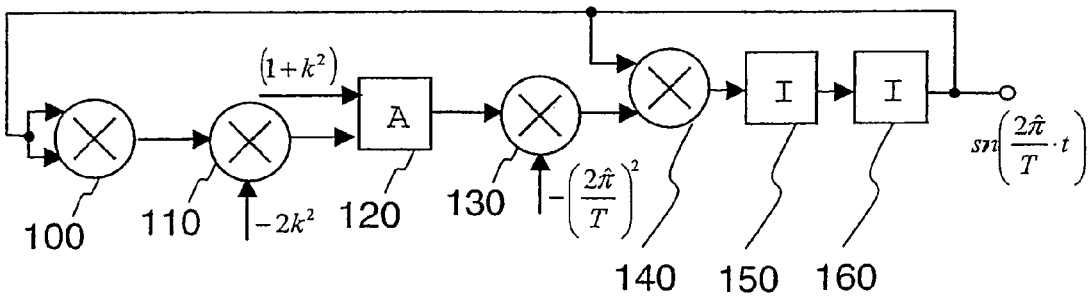
FIG. 2 shows an analog circuit system for generating an output signal which corresponds to the Jacobi elliptic time function $$sn\left(\frac{2\hat{\pi}}{T} \cdot t\right).$$

An exemplary analog circuit system which simulates this differential equation (8) is shown in FIG. 2.

The analog circuit system has a multiplier 100 whose output is connected to a series-connected multiplier 110. Moreover, the factor $-2k^2$ is applied to the input of multiplier 110. The output of multiplier 110 is connected to an input of an adder 120. The factor $1+k^2$ is applied to a second input of adder 120. The output of adder 120 is connected to the input of a multiplier 130. The factor $$-\left(\frac{2\hat{\pi}}{T}\right)^2$$

is applied to a further input of multiplier 130. The output of multiplier 130 is connected to an input of a multiplier 140. The output of multiplier 140 is connected to an input of an integrator 150. The output of integrator 150 is connected to the input of an integrator 160. The output of integrator 160 is coupled back to the input of multiplier 140 and to two inputs of multiplier 100. In this way, an output signal whose curve shape corresponds to the Jacobi elliptic time function $$sn\left(\frac{2\hat{\pi}}{T}\cdot t\right)$$

appears at the output of integrator 160.

The multiplication by the factor $$\left(\frac{2\hat{\pi}}{T}\right)^2$$

may expediently be carried out again in integrators 150 and 160.

Figure 3:
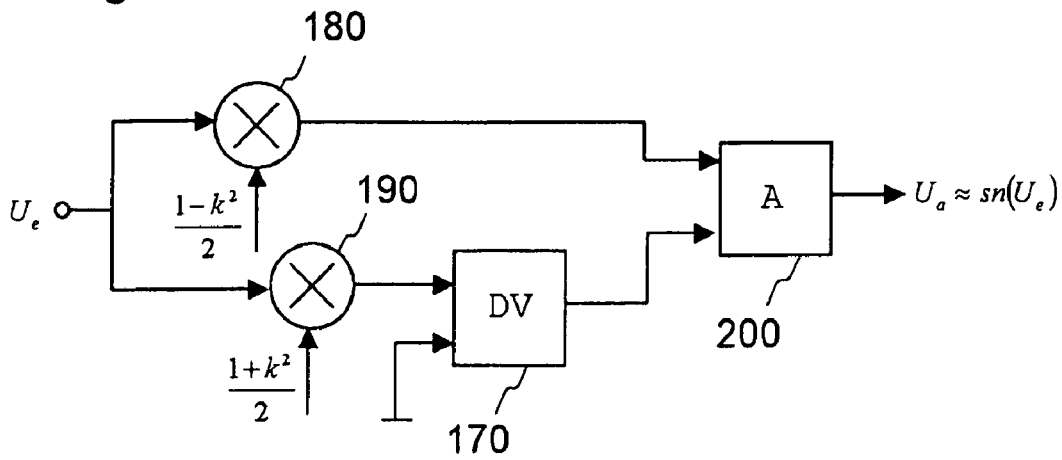
FIG. 3 shows an analog circuit system for generating an output signal which is combined with a triangular input signal by the Jacobi elliptic time function $sn(U_e)$.

In FIG. 3, an exemplary embodiment is described in which a functional relationship corresponding to the Jacobi elliptic function sn(2$\hat{\pi}$ft) approximatively exists between an input signal and an output signal.

The analog circuit system shown in FIG. 3 includes a differential amplifier 170, a multiplier 180, a multiplier 190 and an adder 200. An input signal having a triangular voltage curve is applied, for example, at each input of the multipliers 180, 190. Moreover, the factor $(1-k^2)/2$ is applied to multiplier 180, whereas the factor $(1+k^2)/2$ is applied to multiplier 190. The output signal of multiplier 190 is fed to differential amplifier 170. The second input of the differential amplifier is connected to ground. The output of multiplier 180 and the output of differential amplifier 170 are connected to the inputs of adder 200.

Because of the fact that differential-amplifier circuit 70 has a relation between input signal $U_e$ and output signal $U_a$ according to the equation $$U_a = R \cdot I \cdot \tanh\left(\frac{U_e}{2U_T}\right), \tag{9}$$

given suitably selected parameters of the differential amplifier, the circuit system shown in FIG. 3 generates at the output, a signal $U_a$, which is approximatively combined with input signal $U_e$ via the Jacobi elliptic function sn. Notably, combining or linking an output signal and an input signal via the Jacobi elliptic function cn or dn in a circuit system is available knowledge in the art.

To be able to generate further elliptic functions, a division device (not shown) may be connected in series to the circuit system shown in FIG. 1. For instance, to generate the elliptic function sd(x)=sn(x)/dn(x), the output signals of the integrators 30, 60 may be fed (or added) to the division device. Furthermore, the output signals of the integrators 60, 90 may be fed to the division device, in order to generate the elliptic function cd(x)=cn(x)/dn(x).

In embodiments, it may be desirable to selectively control frequency f or the value of k.

According to equation (4), it is possible to change the value $\hat{\pi}$ by changing the value k. That is to say, $\hat{\pi}$ and therefore k may be calculated by calculating the arithmetic-geometric mean $M(1, \sqrt{1-k^2})$. One possibility for altering the frequency of the Jacobi elliptic functions generated using the circuit system according to FIG. 1 is to feed a selectively altered value for $\hat{\pi}$ to the multipliers 20, 50, 80.

Figure 4:
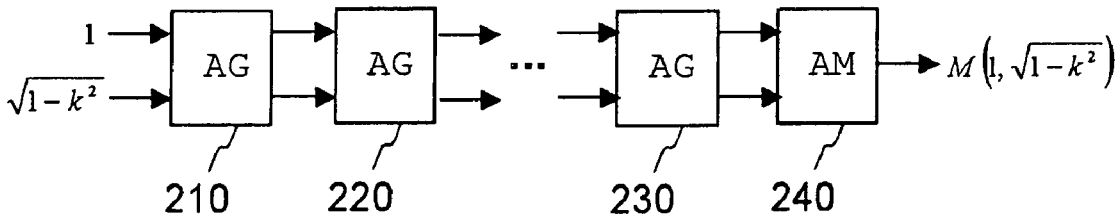
FIG. 4 shows an analog circuit system which, from two input signals, supplies an estimate for the arithmetic-geometric mean M.

To be able to generate $\hat{\pi}$ in terms of circuit engineering, the arithmetic-geometric mean $M(1, \sqrt{1-k^2})$ may be realized, for example, using an analog circuit system which is shown in FIG. 4. The circuit system shown in FIG. 4 is made up of a plurality of analog computing circuits 210, 220, 230, denoted by AG, as well as an analog computing circuit 240 for calculating the arithmetic mean from two input signals. Some analog computing circuits 210, 220, 230 are adapted in such a way that they generate the arithmetic mean of the two input signals at one output, and the geometric mean of the two input signals at the other output. As shown in FIG. 4, the factor 1 is applied to the first input of analog computing circuit 210, and the factor $\sqrt{1-k^2}$ is applied to its other input. On condition that the factor $\sqrt{1-k^2}$ lies between 0 and 1, the output signal of analog computing circuit 240 corresponds approximately to the arithmetic-geometric mean M of the factors 1 and $\sqrt{1-k^2}$ applied to the inputs of analog computing circuit 210.

Figure 5:
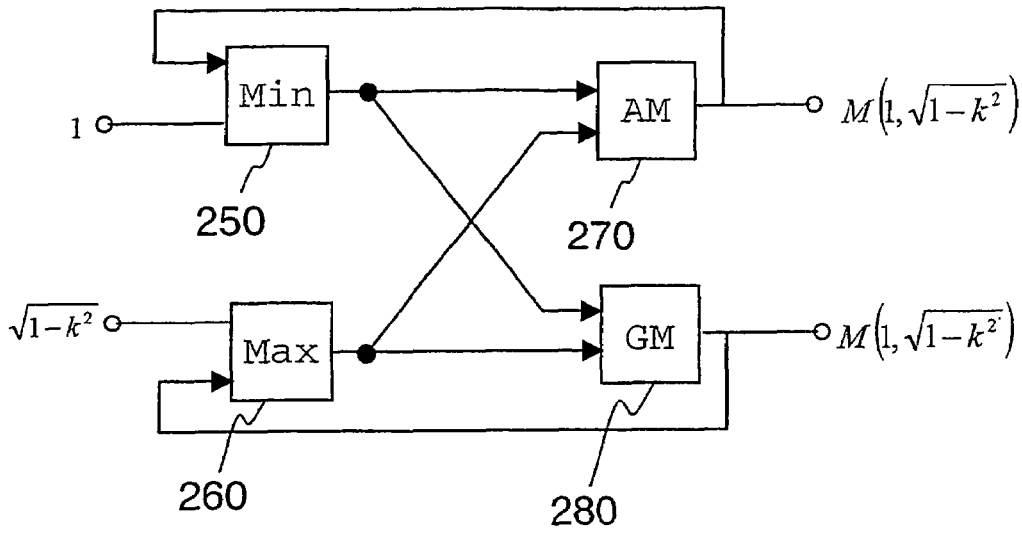
FIG. 5 shows an alternative analog circuit system for calculating the arithmetic-geometric mean M from two input signals.

FIG. 5 shows an alternative analog circuit system for calculating the arithmetic-geometric mean M of the two factors 1 and $\sqrt{1-k^2}$. The circuit system shown in FIG. 5 has an analog computing circuit 250 for calculating the minimum from two input signals, an analog computing circuit 260 for calculating the maximum from two input signals, an analog computing circuit 270 for calculating the arithmetic mean from two input signals and an analog computing circuit 280 for calculating a geometric mean from two input signals. The factor 1 is applied to an input of analog computing circuit 250, whereas the factor $\sqrt{1-k^2}$ is applied to an input of analog computing circuit 260. The output of analog computing circuit 250 for calculating the minimum from two input signals is connected to the input of analog computing circuit 270 and analog computing circuit 280. The output of analog computing circuit 260 for calculating the maximum from two input signals is connected to an input of analog computing circuit 270 and an input of analog computing circuit 280. The output of analog computing circuit 270 is connected to an input of analog computing circuit 250, whereas the output of analog computing circuit 280 is connected to an input of analog computing circuit 260. In the analog circuit system shown in FIG. 5, the outputs of analog computing circuits 270 and 280 in each case supply the arithmetic-geometric mean M of 1 and $\sqrt{1-k^2}$.

Transit-time effects, which can be handled with methods (e.g., sample-and-hold elements) generally used in circuit engineering, are not taken into account in the technical implementation of the circuit system according to FIG. 5.

Figure 6:
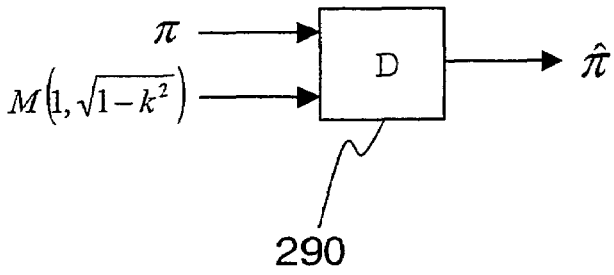
FIG. 6 shows a divider for generating the value $\hat{\pi}$.

At this point, $\hat{\pi}$ may be calculated via a division device 290, shown in FIG. 6, at whose inputs are applied the number $\pi$ and the arithmetic-geometric mean $M(1, \sqrt{1-k^2})$, which is generated, for example, by the circuit shown in FIG. 4 or in FIG. 5.

In this way, selectively altered values for $\hat{\pi}$ may be fed to multipliers 20, 50, 80 of the circuit system according to FIG. 1, which means the frequency response of the output functions may be selectively influenced.

What is claimed is:

1. An analog circuit system, comprising:

a plurality of analog multipliers;

a plurality of analog integrators; and a plurality of analog computing circuits, each analog computing circuit having at least one analog multiplier of the plurality of analog multipliers and analog integrator of the plurality of analog integrators, wherein the plurality of analog multipliers and the plurality of analog integrators are interconnected so that the analog circuit system delivers three output signals whose curve shapes, at least sectionally, respectively correspond to the Jacobi elliptic time functions $$sn\left(\frac{2\hat{\pi}}{T}\cdot t, k\right), cn\left(\frac{2\hat{\pi}}{T}\cdot t, k\right) \text{ and } dn\left(\frac{2\hat{\pi}}{T}\cdot t, k\right), \text{ where } \hat{\pi} = \frac{\pi}{M(1, \sqrt{1-k^2})}$$

and $M(1, \sqrt{1-k^2})$ represents the arithmetic-geometric mean of 1 and $\sqrt{1-k^2}$, and k lies in the interval [0, 1].

2. The analog circuit system of claim 1, further comprising:

an analog division device, wherein one of the following is appliable to an input of the analog division device: output signals sn(x, k) and dn(x, k) in order to generate an analog division device output signal according to an elliptic function sd(x,k), output signals sn(x, k) and cn(x, k) in order to generate an analog division device output signal according to an elliptic function sc(x, k), and output signals cn(x, k) and dn(x, k) in order to generate an analog division device output signal according to an elliptic function cd(x, k).

3. The analog circuit system of claim 1, further comprising:

at least one analog computing circuit, at whose first input a value 1 is applied and at whose second input a value $\sqrt{1-k^2}$ is applied, at whose first output an arithmetic mean of the two input signals is present and at whose second output a geometric mean of the two input signals is present, and another analog computing circuit, connected to the outputs of one of the at least one analog computing circuit, for calculating the arithmetic mean which corresponds approximately to the arithmetic-geometric mean $M(1, \sqrt{1-k^2})$.

4. An analog circuit system comprising:

an analog computing circuit for calculating a minimum from two input signals;

an analog computing circuit for calculating a maximum from two input signals;

an analog computing circuit for calculating an arithmetic mean from two input signals;

an analog computing circuit for calculating a geometric mean from two input signals, wherein an output of the analog computing circuit for calculating the minimum is connected to the input of the analog computing circuit for calculating the arithmetic mean and the input of the analog computing circuit for calculating the geometric mean, wherein an output of the analog computing circuit for calculating the maximum is connected to another input of the analog computing circuit for calculating the arithmetic mean and another input of the analog computing circuit for calculating the geometric mean, the input of the analog computing circuit for calculating the minimum is connected to an output of the analog computing circuit for calculating the arithmetic mean, and a factor 1 is applied to the other input, and wherein the input of the analog computing circuit for calculating the maximum is connected to an output of the analog computing circuit for calculating the geometric mean, and a factor $(1-k^2)$ is applied to the other input, so that an arithmetic-geometric mean $M(1, \sqrt{1-k^2})$ is present at the output of the analog computing circuit for calculating the geometric mean and at the output of the analog computing circuit for calculating the arithmetic mean.

5. The analog circuit system of claim 1, further comprising a device for generating the value $\hat{\pi}$ from the arithmetic-geometric mean $M(1, \sqrt{1-k^2})$ and the number $\pi$.

6. An analog circuit system comprising:

a plurality of analog computing circuits which generate at least one output signal whose curve shape, at least sectionally, corresponds to an elliptic function, a first multiplier, at whose inputs the input signal of the variable x and a factor $(1-k^2)/2$ are applied, a second multiplier, at whose inputs a triangular input signal and a factor $(1+k^2)/2$ are applied, a differential amplifier that, on the incoming side, is connected to ground and to the output of the second multiplier, and an adder that is connected to the output of the first multiplier and the output of the differential amplifier, an output signal that is combined with the input variable x by the Jacobi elliptic function sn(x, k) being present at the output of the adder, wherein the plurality of analog computing circuits are interconnected in such a way that, with an input signal of the variable x, the output signal of the circuit system approximatively delivers the value sn(x, k).

7. The analog circuit system of claim 6, wherein the input signal to the first multiplier is a triangular input signal.

* * * * *

UNITED STATES PATENT AND TRADEMARK OFFICE

CERTIFICATE OF CORRECTION

PATENT NO. : 7,584,238 B2
APPLICATION NO. : 10/555513
DATED : September 1, 2009
INVENTOR(S) : Klaus Huber It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 791 days.

Signed and Sealed this

Fourteenth Day of December, 2010

David J. Kappos

David J. Kappos
*Director of the United States Patent and Trademark Office*